US007287610B2

(12) United States Patent
Svendsen et al.

(10) Patent No.: US 7,287,610 B2
(45) Date of Patent: Oct. 30, 2007

(54) CUTTING ELEMENTS AND BITS INCORPORATING THE SAME

(75) Inventors: Zan Svendsen, Lakewood, CO (US); Yuelin Shen, Houston, TX (US); Youhe Zhang, Tomball, TX (US)

(73) Assignee: Smith International, Inc., Houston, TX (US)

( * ) Notice: Subject to any disclaimer, the term of this patent is extended or adjusted under 35 U.S.C. 154(b) by 224 days.

(21) Appl. No.: 10/954,122

(22) Filed: Sep. 29, 2004

(65) Prior Publication Data

US 2006/0065447 A1 Mar. 30, 2006

(51) Int. Cl.
*E21B 10/36* (2006.01)

(52) U.S. Cl. ..... 175/432; 175/428

(58) Field of Classification Search ..... 175/432, 175/426, 428, 431
See application file for complete search history.

(56) References Cited

U.S. PATENT DOCUMENTS 4,784,023 A 11/1988 Dennis
5,120,327 A 6/1992 Dennis
5,154,245 A 10/1992 Waldenström et al.
5,217,081 A 6/1993 Waldenström et al.
5,348,108 A * 9/1994 Scott et al. ..... 175/432
5,351,772 A 10/1994 Smith
5,355,969 A 10/1994 Hardy et al.
5,472,376 A 12/1995 Olmstead et al.
5,486,137 A 1/1996 Flood et al.
5,492,188 A * 2/1996 Smith et al. ..... 175/432
5,564,511 A 10/1996 Frushour
5,590,729 A 1/1997 Cooley et al.
5,611,649 A 3/1997 Matthias
5,617,928 A 4/1997 Matthias et al.
5,709,279 A 1/1998 Dennis
5,711,702 A 1/1998 Devlin
5,862,873 A 1/1999 Matthias et al.
5,871,060 A * 2/1999 Jensen et al. ..... 175/420.2
5,906,246 A 5/1999 Mensa-Wilmot et al.
5,928,071 A * 7/1999 Devlin ..... 451/547
5,957,228 A 9/1999 Yorston et al.
6,000,483 A 12/1999 Jurewicz et al.
6,011,232 A * 1/2000 Matthias ..... 219/69.17
6,026,919 A 2/2000 Thigpen et al.
6,041,875 A 3/2000 Rai et al.
6,077,591 A * 6/2000 Griffin ..... 428/172
6,082,474 A 7/2000 Matthias
6,135,219 A * 10/2000 Scott ..... 175/432
6,196,340 B1 3/2001 Jensen et al.
6,202,770 B1 3/2001 Jurewicz et al.
6,202,771 B1 3/2001 Scott et al.
6,227,319 B1 5/2001 Radford (Continued)

FOREIGN PATENT DOCUMENTS

EP 0582484 A1 2/1994
GB 2364082 A 1/2002

*Primary Examiner*—Jennifer H. Gay
*Assistant Examiner*—David Andrews
(74) *Attorney, Agent, or Firm*—Christie, Parker & Hale, LLP.

(57) ABSTRACT

Cutting elements and bits incorporating such cutting elements are provided. The cutting elements include a substrate having an interface surface over which is formed an ultra hard material layer. A plurality of lands are formed on the interface surface. A plurality of depressions are formed on the lands.

31 Claims, 4 Drawing Sheets

U.S. PATENT DOCUMENTS 6,315,067 B1 11/2001 Fielder
6,315,652 B1 11/2001 Snyder et al.
6,330,924 B1 12/2001 Hall
6,401,845 B1 6/2002 Fielder
6,405,814 B1 6/2002 Eyre et al.
6,446,740 B2 9/2002 Eyre
6,488,106 B1 12/2002 Dourfaye
6,510,910 B2 1/2003 Eyre et al.
6,513,608 B2 2/2003 Eyre et al.
6,527,069 B1 * 3/2003 Meiners et al. ..... 175/432
6,550,556 B2 4/2003 Middlemiss et al.
6,571,891 B1 6/2003 Smith et al.
6,739,417 B2 5/2004 Smith et al.

* cited by examiner

CUTTING ELEMENTS AND BITS INCORPORATING THE SAME

BACKGROUND OF THE INVENTION

This invention relates to cutting elements and bits incorporating the same and more specifically to cutting elements having a non-uniform interface between their substrate and cutting layer of ultra hard material.

Typically, cutting elements are cylindrical in shape. They have a cemented tungsten carbide substrate having an upper surface. On the upper face is sintered an ultra hard material such as diamond or cubic boron nitride forming a polycrystalline ultra hard material cutting layer.

Common problems that plague cutting elements and specifically cutting elements having an ultra hard material layer bonded on a cemented carbide substrate, are chipping, spalling, partial fracturing, cracking or delamination of the ultra hard material layer. These problems result in the early failure of the cutting layer (i.e., the ultra hard material layer) and thus, in a shorter operating life for the cutting element. Typically, these problems may be the result of peak (high magnitude) stresses generated on the ultra hard material cutting layer at the region in which the ultra hard material layer makes contact with the earth formations during drilling.

One way to attempt to overcome these problems is to increase the thickness of the ultra hard material. Theoretically, an increase in the ultra hard material layer results in increased cutting element impact and wear resistance. However, an increase in the thickness of the ultra hard material layer may result in delamination of the ultra hard material layer from the substrate. Moreover, as the ultra hard material layer thickness increases, the edges and surfaces of the ultra hard material furthest away from the substrate (e.g., the ultra hard material layer upper surface circumferential edge) are starved for cobalt during the sintering process. Consequently, the strength and ductility of these edges is decreased. Thus, the ultra hard material edges subjected to the highest impact loads will be brittle and have lower impact and wear resistance resulting in the early failure of the cutting layer.

Another problem associated with increasing the thickness of the ultra hard material layer is that as the ultra hard material volume increases there is an increase in the residual stresses formed on the ultra hard material due to the thermal coefficient mismatch between the ultra hard material layer and the substrate. The cemented carbide substrate has a higher coefficient of thermal expansion than the ultra hard material. During sintering, both the cemented carbide body and ultra hard material layer are heated to elevated temperatures expanding and forming a bond between the ultra hard material layer and the cemented carbide substrate. The heating causes the substrate to expand more than the ultra hard material. As the ultra hard material layer and substrate cool down, the substrate shrinks more than the ultra hard material because of its higher coefficient of thermal expansion. Consequently, thermally induced compressive stresses are formed on the ultra hard material layer and tensile stresses are formed on the substrate. These stresses may reduce the operating life of a cutting element.

Furthermore, an increase in the volume of the ultra hard material also results in the build-up of residual stresses on the ultra hard material layer/substrate interface due to the difference in shrinkage between the ultra hard material and the substrate caused by the consolidation of the ultra hard material and the consolidation of the substrate after sintering. These residual stresses may also reduce the operating life of a cutting element.

Accordingly, there is a need for a cutting element having an ultra hard material table with improved impact and wear resistance as well as improved cracking, chipping, fracturing, and exfoliating characteristics, and thereby an enhanced operating life.

SUMMARY OF THE INVENTION

In one exemplary embodiment, a cutting element is provided having a substrate having an interface surface and a periphery. A plurality of generally trapezoidal spaced apart peripheral lands are defined on the interface surface, each of the plurality of lands extending to the periphery. A plurality of depressions are formed on a surface of each land. An ultra hard material layer is formed over the interface surface. In another exemplary embodiment, the plurality of depressions are generally polygonal in plan view. In a further exemplary embodiment, the plurality of depressions are generally hexagonal in plan view. In yet another exemplary embodiment, each of the peripheral lands has a side surface aligned with the periphery. The peripheral lands may be arranged around the interface surface. In a further exemplary embodiment, a central land is defined on the interface surface spaced apart from the plurality of peripheral lands, such that the peripheral lands are arranged around the central land. In an exemplary embodiment, the central land is generally hexagonal in plan view. In yet a further exemplary embodiment, the central land has depression formed on its surface. In one exemplary embodiment a generally hexagonal depression is formed on the center of the central land. Six generally trapezoidal depressions are also formed on the central land extending from the sides of the generally hexagonal depression, such that each generally trapezoidal depression abuts two other generally trapezoidal depressions.

In another exemplary embodiment, a cutting element is provided having a substrate having an interface surface and a periphery. A main depression is formed on the interface surface. The main depression has a generally polygonal annular depression in plan view and a radially extending depression extending from each vertex of the generally polygonal annular depression to the periphery, such that a plurality of lands are defined by the main depression. A plurality of secondary depressions are formed on the lands and are shallower than the main depression. An ultra hard material layer is formed over the interface surface. In an exemplary embodiment, the generally polygonal annular depression is formed surrounding a center of the interface surface.

In another exemplary embodiment, the generally polygonal annular depression is generally hexagonal in plan view. The land defined within the generally polygonal annular depression in another exemplary embodiment has a plurality of secondary depressions. In a further exemplary embodiment, the plurality of secondary depressions formed on the land defined within the generally polygonal annular depression include a generally hexagonal central secondary depression surrounded by a plurality of generally trapezoidal secondary depressions.

In yet a further exemplary embodiment, a cutting element is provided having a substrate having an interface surface. A plurality of spaced-apart lands are formed on the interface surface. A plurality of abutting depressions are formed on the lands. Each abutting depression has a generally hexagonal shape in plan view such that the plurality of abutting depressions define a honeycomb pattern on each land. An ultra hard material layer is formed over the interface surface. In an exemplary embodiment each land has height, and each of the abutting depressions formed on each land has a depth that is smaller than this height. In yet another exemplary embodiment, the interface surface has a main depression defining the lands. The main depression may define at least six lands.

In further exemplary embodiments bits are provided incorporating any of the aforementioned exemplary embodiment cutting elements.

DETAILED DESCRIPTION OF THE INVENTION

Figure 1:
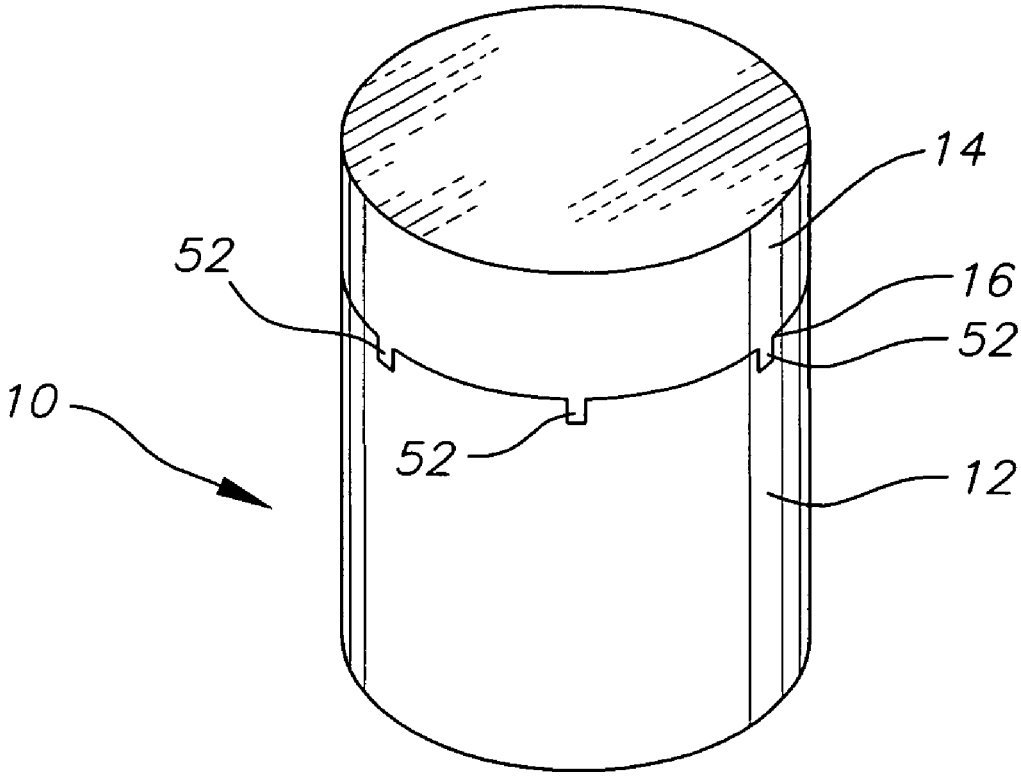
FIG. 1 is a perspective view of an exemplary embodiment cutting element of the present invention.

In an exemplary embodiment, cutting elements 10 are provided each having a substrate 12 over which is formed an ultra hard material layer 14 such as a polycrystalline diamond ("PCD") or a polycrystalline cubic boron nitride ("PCBN") ultra hard material layer as for example shown in FIG. 1. It should be noted that the term "substrate" as used herein refers to the portion or layer of the cutting element interfacing with the ultra hard material layer. For example, if a transition layer is incorporated between the ultra hard material layer and a body of the cutting element, the transition layer will be deemed a "substrate." In addition, the body will also be deemed a substrate. It should also be noted that the Figures herein are used for illustrative purposes and are not to scale.

In an exemplary embodiment, the substrate is formed from tungsten carbide. In an exemplary embodiment, the substrate has an end surface 16 defining an interface surface for interfacing with the ultra hard material layer, as for example shown in FIGS. 1 and 2. A main depression 18 is formed on the interface surface defining a path having in plan view a generally hexagonal portion 20 and radial portions 22 extending from each vertex 23 of the hexagonal portion to the periphery 24 of the substrate. Consequently six equidistantly spaced protrusions or lands 26 are defined on the interface surface and extend to the periphery 24 of the substrate. These lands are referred to herein for convenience as the "peripheral lands". Also defined is a central generally hexagonal protrusion or land 26 surrounded by the generally hexagonal portion of the path and referred to herein for convenience as the "central land".

Figure 2:
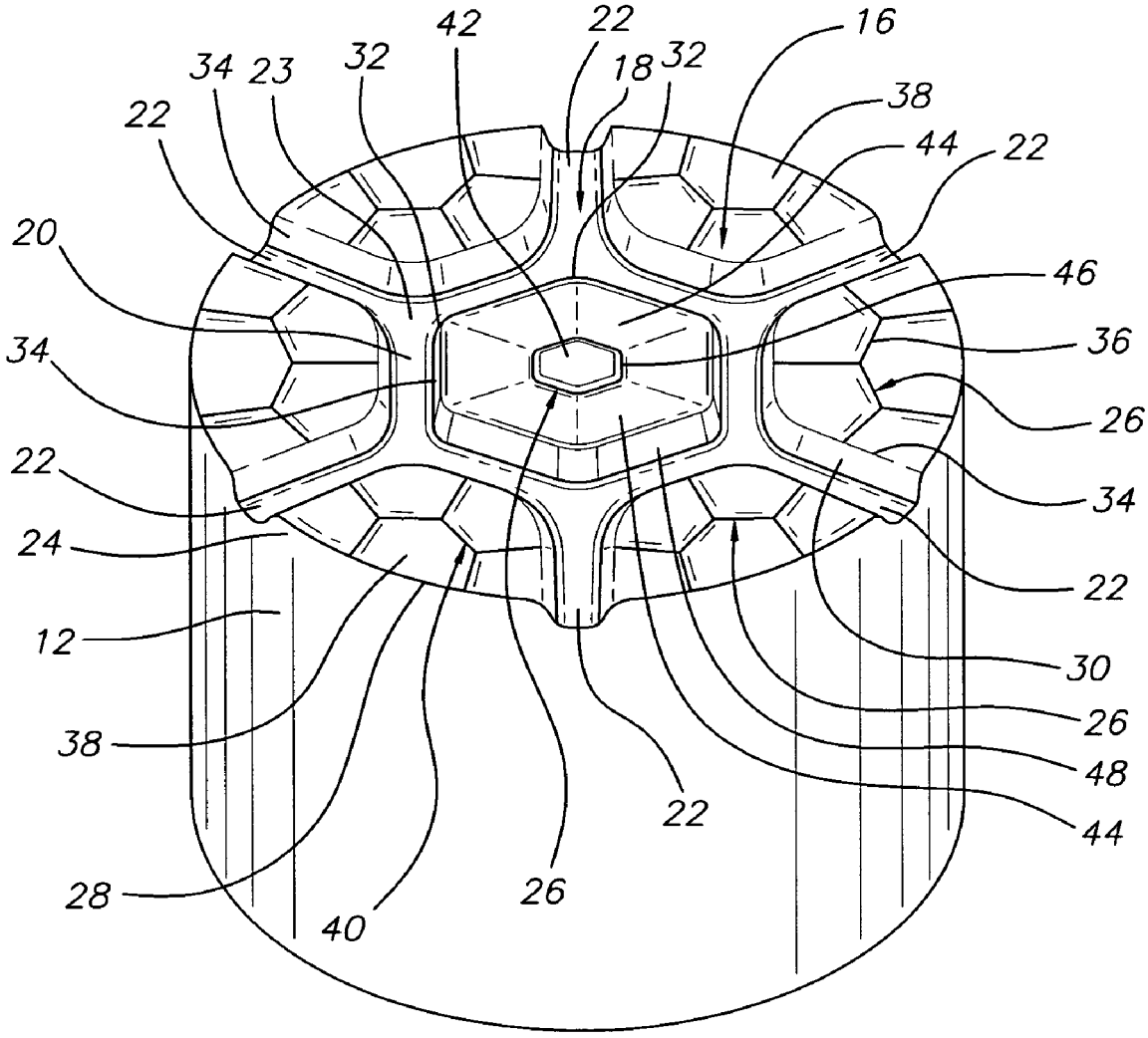
FIG. 2 is a perspective view of a substrate of an exemplary embodiment cutting element of the present invention.

The peripheral lands 26 are "generally trapezoidal" in plan view. The base 28 of each peripheral land which is defined by the periphery 24 of the substrate has the curvature of the substrate. In the exemplary embodiment as shown in FIG. 2, in order to minimize residual stresses that tend to form on the interface surface, all the angles of the main depression are rounded. Consequently, the corners 30 of the peripheral lands opposite their base 28 are rounded. Similarly, the vertices 32 of the central land are rounded. Furthermore, in the exemplary embodiment, the edges 34 of the peripheral and central lands defined by the main depression and interfacing with the upper surfaces 36 of the lands are also curved to minimize residual stresses. It should be noted, the plan shape of the peripheral lands is referred to as "generally trapezoidal" since at least one side defining the trapezoid, i.e., the base, has a curvature and/or since at least some of the vertices of the trapezoid may be rounded, thus not defining a true trapezoid. Consequently the phrase "generally trapezoidal" as used herein in relation to an element encompasses elements that are true trapezoids as well as trapezoidal elements that have one or more curved sides and/or one or more rounded corners.

It should also be noted that the terms "upper" and "lower" as are used herein to describe relative positions and not exact positions of elements. Thus, an "upper" surface may be lower than a "lower" surface.

In further exemplary embodiment, depressions that are shallower than the main depression are formed on the upper surfaces of the lands. In the exemplary embodiment, shown in FIG. 2, these shallow depressions 38 are generally hexagonal in plan view and abut each other defining a honeycomb like pattern 40 on the upper surfaces of the peripheral lands. In the exemplary embodiment, a shallow hexagonal depression 42 is formed at the center of the central land. Six generally trapezoidal and almost triangular shallow depressions 44 extend radially outward from each side 46 of the central shallow depression to the periphery 48 of the central land. Each generally trapezoidal shallow depression abuts two other generally trapezoidal shallow depressions, one on each side. In the exemplary embodiment, the shallow depressions formed on the central land form an axisymmetric pattern. The shallow depressions are defined as being "generally" hexagonal or "generally" trapezoidal because some of their vertices may be rounded consequently not forming true hexagons or triangles. Consequently the phrases "generally" as used herein in relation to a polygonal element, as for example a hexagonal, triangular, or trapezoidal element encompass elements that are true polygons as well as polygonal elements that have one or more curved sides and/or one or more rounded corners.

In the exemplary embodiment shown in FIG. 2 the upper surfaces 36 of the lands, notwithstanding the shallow depressions, generally extend along a planar surface. In an alternate exemplary embodiment the upper surfaces, notwithstanding the shallow depressions, may extend along a concave surface or a convex surface, as for example a dome shaped surface.

When the ultra hard material layer is formed over the interface surface, the surface of the ultra hard material layer interfacing with the interface surface of the substrate is complementary in shape to the interface of the substrate. As such, the ultra hard material layer surface interfacing with the interface surface of the substrate will include a main protrusion having a hexagonal portion and radial portions or ribs 52 complementary to the main depression hexagonal and radial portions.

Figure 4:
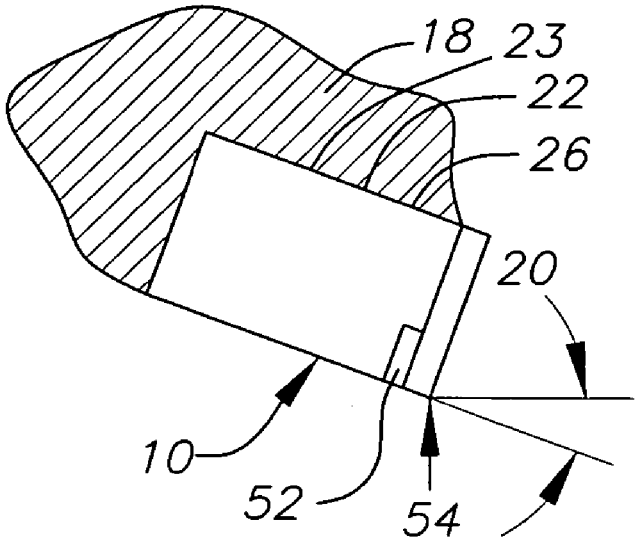
FIG. 4 is a cross-sectional view of an exemplary cutting element and bit taken along arrows 4-4 shown in FIG. 3.
Figure 3:
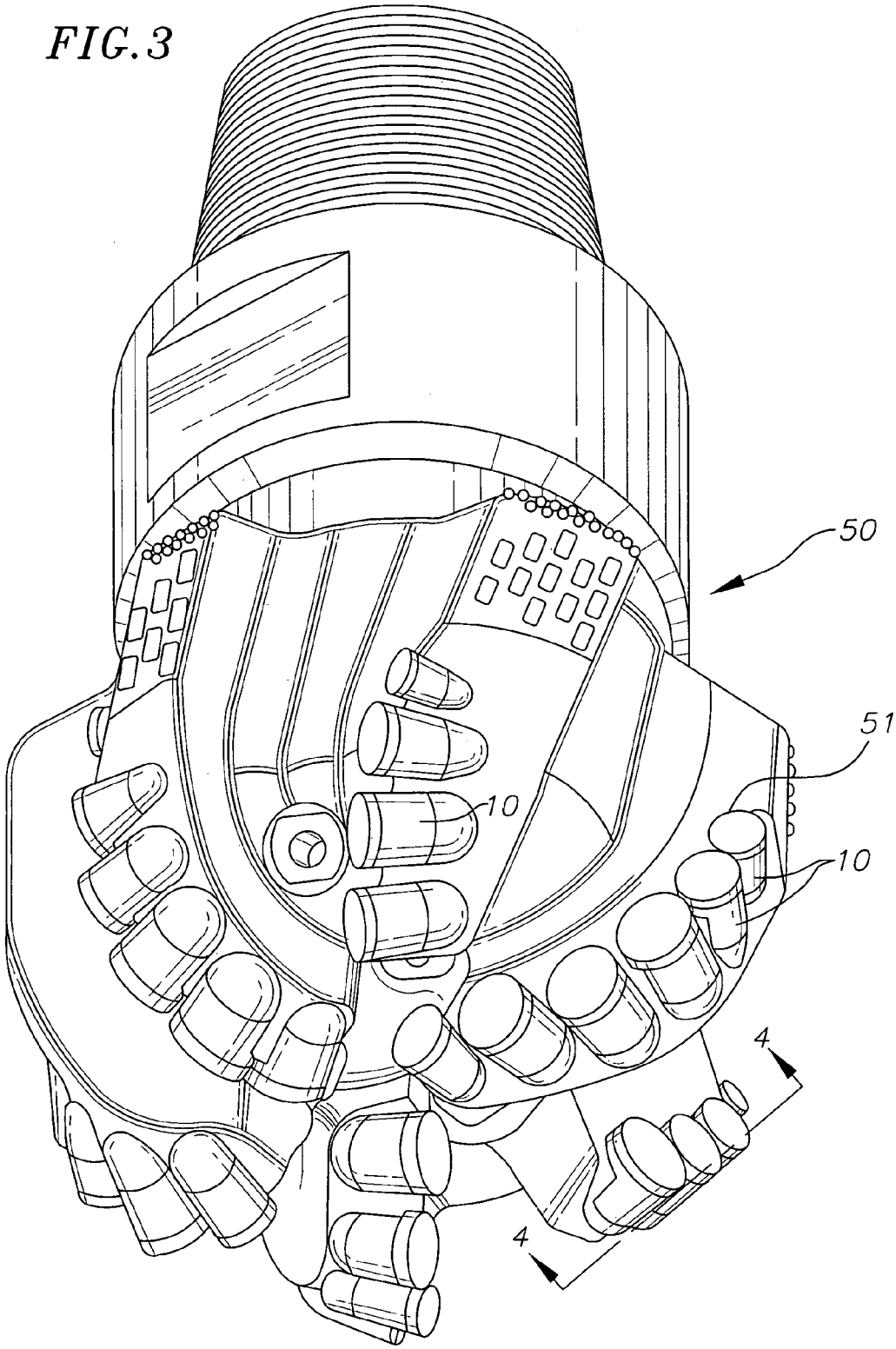
FIG. 3 is a perspective view of a bit incorporating exemplary embodiment cutting elements of the present invention.

In one exemplary embodiment, an exemplary embodiment cutting element is mounted on a bit pocket 51 of a bit 50 such as a drag bit, as for example, shown in FIG. 3. The cutting element is mounted on the bit such that a radially extending rib 52 of the ultra hard material layer is aligned with the edge 54 of the ultra hard material layer that would make contact with the earth formation during drilling, as for example shown in FIG. 4. In this regard the volume of the ultra hard material making contact with the earth formation is increased in the immediate locality of the impact whereas the overall volume of the ultra hard material layer is not significantly increased. Consequently, the residual stresses as well as the risk of delamination and other problems, which are common with an increase in the volume of ultra hard material, are not significantly increased.

Figure 5:
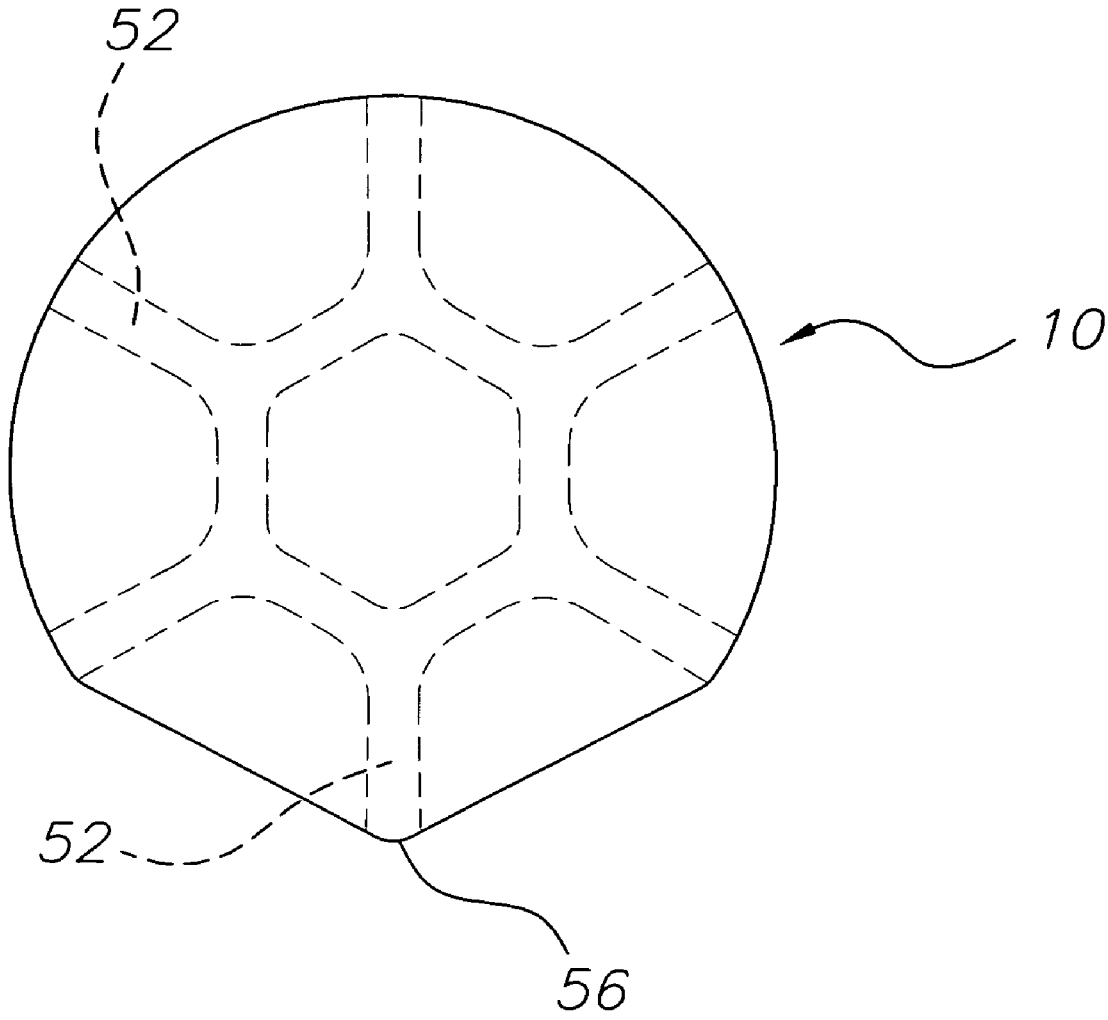
FIG. 5 is a top view of an exemplary embodiment cutting element of the present invention with portions of the cutting element worn off.

Moreover, as an exemplary embodiment cutting element cuts the earth formations, the cutting element ultra hard material layer and the substrate material on either side of the rib 52 wear off such that a narrowing of the cutting element is formed defining a point 56 which enables the cutter to become more aggressive in cutting, as for example shown in FIG. 5. This pointing or arrowing effect of the cutting element is maintained as the cutting element continues to cut and as the cutting element wears off. Consequently, the cutting efficiency of the cutting element is maintained even when the cutting element is worn.

As the exemplary embodiment cutting elements wear off, they can be rotated within the bit pocket such that a new radial ultra hard material projection 52 is aligned to make contact with the earth formation during drilling.

Applicants believe that the honeycomb pattern defined by the shallower depressions on the peripheral lands and the axisymmetric pattern of the shallower depressions formed on the central land of the exemplary embodiment cutting element better distribute, and reduce the magnitude, of the residual stresses generated during sintering of the ultra hard material. Thus, cutting elements of the present invention should have longer operating lives than conventional cutting elements.

The substrates of the exemplary embodiment cutting elements may be formed using well known methods. For example, tungsten carbide particles may be mixed with a cobalt binder, wax and solvent and placed in a mold for forming a substrate having the desired geometry. In the exemplary embodiment, a mold may be used that will produce the desired pattern on the interface of the substrate. The mold with mixture of material are heated and held to a predetermined temperature to "dewax" the mixture. The temperature is then further raised and held to another predetermined value causing the cobalt binder to cement the tungsten carbide particles together forming the substrate.

In another exemplary embodiment, the substrate may be formed to have a cylindrical shape. The interface pattern may then be machined on the interface using well known methods such as electro-discharge machining ("EDM") and grinding. Other known methods for forming the substrate may also be used.

To form the cutting element of the present invention, the substrate with the desire geometry interface is placed in can made from a material such as niobium. Ultra hard material powder such as diamond or cubic boron nitride and a binder are then placed over the substrate interface surface in the can. The can is covered and subjected to high pressure and high temperature whereby the ultra hard material becomes polycrystalline and bonds to the substrate.

Although specific exemplary embodiments are disclosed herein, it is expected that persons skilled in the art can and will design alternative cutting elements and methods to produce the cutting elements that are within the scope of the following claims either literally or under the doctrine of equivalents.

What is claimed is:

1. A cutting element comprising:

a substrate having an interface surface and a periphery;

a plurality of generally trapezoidal spaced-apart peripheral lands defined on the interface surface, each of said plurality of peripheral lands having a narrower side opposite a wider side, wherein the wider side of each peripheral land extends to the periphery;

a plurality of depressions formed on a surface of each land; and an ultra hard material layer formed over the interface surface.

2. A cutting element as recited in claim 1 wherein each of the plurality of depressions is generally polygonal in plan view.

3. A cutting element as recited in claim 2 wherein each of the plurality of depressions is generally hexagonal in plan view.

4. A cutting element as recited in claim 3 wherein each of said peripheral lands has a side surface aligned with the periphery.

5. A cutting element as recited in claim 4 wherein the peripheral lands are equidistantly arranged around the interface surface.

6. A cutting element as recited in claim 5 wherein the plurality of generally hexagonal depressions on each peripheral land abut each other defining a honeycomb pattern.

7. A cutting element as recited in claim 6 further comprising a central land spaced-apart from the plurality of peripheral lands, wherein said peripheral lands are arranged around said central land.

8. A cutting element as recited in claim 7 wherein the central land comprises a generally hexagonal shape in plan view.

9. A cutting element as recited in claim 8 wherein the central land comprises a plurality of secondary depressions.

10. A cutting element as recited in claim 8 wherein the central land comprises a generally hexagonal secondary depression formed on a center of the central land and six generally trapezoidal secondary depressions, each generally trapezoidal secondary depression extending from a side of said generally hexagonal secondary depression formed on said central land, wherein each generally trapezoidal secondary depressions abuts two other generally trapezoidal secondary depressions.

11. A cutting element as recited in claim 10 wherein a main depression is defined on the interface surface between the peripheral and central lands, wherein the main depression comprises an annular generally hexagonal portion and six radial portions, each radial portion extending from a vertex of the annular generally hexagonal portion to the periphery.

12. A cutting element as recited in claim 11 wherein all the depressions formed on the peripheral and central lands are shallower than the main depression.

13. A cutting element as recited in claim 1 further comprising a central land spaced-apart from the plurality of peripheral lands, wherein said peripheral lands are arranged around said central land.

14. A cutting element comprising:

a substrate having an interface surface and a periphery;

a main depression formed on the interface surface, the main depression comprising a generally polygonal annular depression in plan view and a radially extending depression extending from each vertex of the generally annular depression to the periphery, wherein a plurality of spaced-apart peripheral lands are defined by said main depression, wherein each of said peripheral lands extends from the polygonal annular depression to the periphery, and wherein an inner land is defined by the annular depression, wherein the peripheral lands are arranged around the inner land and are spaced-apart from the inner land;

a plurality of secondary depressions formed on said lands, said secondary depressions being shallower than said main depression, wherein said plurality of secondary depressions formed on the inner land comprise a generally hexagonal central secondary depression surrounded by a plurality of secondary generally trapezoidal depressions; and an ultra hard material layer formed over the interface surface.

15. A cutting element as recited in claim 14 wherein the generally polygonal annular depression is formed surrounding a center of said interface surface.

16. A cutting element as recited in claim 14 wherein the generally polygonal annular depression is generally hexagonal in plan view.

17. A cutting element as recited in claim 14 wherein each generally trapezoidal secondary depression abuts two other generally trapezoidal secondary depressions.

18. A cutting element as recited in claim 14 wherein the generally polygonal annular depression is located centrally on the interface surface.

19. A cutting element as recited in claim 18 wherein the generally polygonal annular depression is generally hexagonal in plan view.

20. A bit comprising:

a body; and a cutting element mounted on the body, wherein the cutting element comprises, a substrate having an interface surface and a periphery, a plurality of generally trapezoidal spaced-apart peripheral lands defined on the interface surface, each of said plurality of peripheral lands having a narrower side opposite a wider side, wherein the wider side of each peripheral land extends to the periphery, a plurality of depressions formed on a surface of each land, and an ultra hard material layer formed over the interface surface.

21. A bit as recited in claim 20 wherein each of the plurality of depressions formed on the cutting element are generally hexagonal in plan view and abut each other defining a honeycomb pattern.

22. A bit comprising:

a body; and a cutting element mounted on the body, the cutting element comprising, a substrate having an interface surface and a periphery;

a main depression formed on the interface surface, the main depression comprising a generally polygonal annular depression in plan view and a radially extending depression extending from each vertex of the generally annular depression to the periphery, wherein a plurality of spaced-apart peripheral lands are defined by said main depression, wherein each of said peripheral lands extends from the polygonal annular depression to the periphery, and wherein an inner land is defined by the annular depression, wherein the peripheral lands are arranged around the inner land and are spaced-apart from the inner land;

a plurality of secondary depressions formed on said lands, said secondary depressions being shallower than said main depression, wherein said plurality of secondary depressions formed on the inner land comprise a generally hexagonal central secondary depression surrounded by a plurality of secondary generally trapezoidal depressions; and an ultra hard material layer formed over the interface surface.

23. A cutting element comprising:

a substrate having an interface surface and a periphery;

a plurality of generally trapezoidal spaced-apart peripheral lands defined on the interface surface, each of said plurality of lands extending to the periphery;

a central land spaced-apart from the plurality of peripheral lands, wherein said peripheral lands are arranged around said central land;

a plurality of depressions formed on a surface of each peripheral land; and an ultra hard material layer formed over the interface surface.

24. A bit comprising:

a body; and a cutting element mounted on the body, wherein the cutting element comprises, a substrate having an interface surface and a periphery, a plurality of generally trapezoidal spaced-apart peripheral lands defined on the interface surface, each of said plurality of lands extending to the periphery, a central land spaced-apart from the plurality of peripheral lands, wherein said peripheral lands are arranged around said central land, a plurality of depressions formed on a surface of each peripheral land, and an ultra hard material layer formed over the interface surface.

25. A cutting element comprising:

a substrate having an interface surface and a periphery;

a plurality of generally trapezoidal spaced-apart peripheral lands defined on the interface surface, each of said plurality of peripheral lands extending to the periphery and having a side surface aligned with the periphery, said peripheral lands being equidistantly arranged around the interface surface;

a central land having generally hexagonal shape in plan view and being spaced-apart from the plurality of peripheral lands, wherein said peripheral lands are arranged around said central land, wherein the central land comprises a generally hexagonal secondary depression formed on a center of the central land and six generally trapezoidal secondary depressions, each generally trapezoidal secondary depression extending from a side of said generally hexagonal secondary depression formed on said central land, wherein each generally trapezoidal secondary depressions abuts two other generally trapezoidal secondary depressions;

a plurality of depressions formed on a surface of each peripheral land, wherein each of the plurality of depressions on the surface of each peripheral land is generally hexagonal in plan view, wherein said plurality of generally hexagonal depressions on each peripheral land abut each other defining a honeycomb pattern; and an ultra hard material layer formed over the interface surface.

26. A cutting element as recited in claim 25 wherein a main depression is defined on the interface surface between the peripheral and central lands, wherein the main depression comprises an annular generally hexagonal portion and six radial portions, each radial portion extending from a vertex of the annular generally hexagonal portion to the periphery.

27. A cutting element as recited in claim 26 wherein all the depressions formed on the peripheral and central lands are shallower than the main depression.

28. A cutting element comprising:

a substrate having an interface surface and a periphery;

a main depression formed on the interface surface, the main depression comprising a generally polygonal annular depression in plan view and a radially extending depression extending from each vertex of the generally polygonal annular depression to the periphery, wherein a plurality of outer lands are defined by said main depression, and wherein an inner land is defined within the generally polygonal annular depression comprising a plurality of secondary depressions, and wherein said plurality of secondary depressions formed on the inner land defined within the generally polygonal annular depression comprise a generally hexagonal central secondary depression surrounded by a plurality of secondary generally trapezoidal depressions;

a plurality of secondary depressions formed on said plurality of outer lands, said secondary depressions being shallower than said main depression; and an ultra hard material layer formed over the interface surface.

29. A cutting element as recited in claim 28 wherein the generally polygonal annular depression is formed surrounding a center of said interface surface.

30. A cutting element as recited in claim 28 wherein each generally trapezoidal secondary depression abuts two other generally trapezoidal secondary depressions.

31. A cutting element as recited in claim 28 wherein the generally polygonal annular depression is generally hexagonal in plan view.

* * * * *

UNITED STATES PATENT AND TRADEMARK OFFICE

CERTIFICATE OF CORRECTION

PATENT NO. : 7,287,610 B2
APPLICATION NO. : 10/954122
DATED : October 30, 2007
INVENTOR(S) : Zan Svendsen et al.

It is certified that error appears in the above-identified patent and that said Letters Patent is hereby corrected as shown below:

In the Claims

| | |
|---|---|
| Column 6, line 44, claim 10 | Delete "depressions",<br>Insert --depression-- |
| Column 8, line 43, claim 25 | After "having",<br>Insert --a-- |
| Column 8, line 53, claim 25 | Delete "depressions",<br>Insert --depression-- |

Signed and Sealed this

Tenth Day of June, 2008

JON W. DUDAS
*Director of the United States Patent and Trademark Office*